United States Patent [19]

Hilton

[11] 4,456,260

[45] Jun. 26, 1984

[54] PROPERTY GAME HAVING INNER PATH SPACE MARKERS

[76] Inventor: Allen L. Hilton, 756 N. 300 East, Pleasant Grove, Utah 84062

[21] Appl. No.: 399,909

[22] Filed: Jul. 19, 1982

[51] Int. Cl.[3] ..... A63F 3/00

[52] U.S. Cl. ..... 273/256

[58] Field of Search ..... 273/254, 256, 278

[56] References Cited

U.S. PATENT DOCUMENTS

| | | | |
|---|---|---|---|
| 1,509,312 | 9/1924 | Phillips . | |
| 2,026,082 | 12/1935 | Darrow . | |
| 2,691,528 | 10/1954 | Laidlaw . | |
| 3,556,528 | 1/1971 | Spiring | 273/254 |
| 3,801,104 | 4/1974 | Potts et al. | 273/254 |
| 3,865,381 | 2/1975 | Hayes . | |
| 3,889,954 | 6/1975 | Malisow . | |
| 3,892,408 | 7/1975 | Small et al. . | |
| 3,973,775 | 8/1976 | Bolan et al. | 273/253 |
| 4,010,954 | 3/1977 | Uding | 273/256 X |
| 4,076,249 | 2/1978 | Sneathen, Jr. | 273/256 |
| 4,140,319 | 2/1979 | Aycock et al. | 273/256 |
| 4,162,075 | 7/1979 | Iannucci | 273/256 |
| 4,189,153 | 2/1980 | Zollinger | 273/256 |
| 4,302,016 | 11/1981 | Astle et al. | 273/278 |
| 4,360,205 | 11/1982 | Rimbold | 273/256 |

OTHER PUBLICATIONS

"Fortune 500," Pressman Toy Corporation, New York, NY.

"Careers," Parker Brothers, Inc., Salem, MA.

"Acquire," Avalon Hill Game Company, Baltimore, MD.

"Close Encounters of the Third Kind," Parker Brothers, Inc., Salem, MA.

"Easy Money," Milton Bradley Company.

*Primary Examiner*—Richard C. Pinkham

*Assistant Examiner*—Scott Brown

[57] ABSTRACT

A theme-oriented parlor game and method comprising a game board assembly, title indicia, tokens and movement intiators. The game board assembly has a peripheral region and a central region both subdivided into a plurality of locations. The locations of the peripheral region are grouped into company locations, draw card locations and street locations. The locations of the central region are grouped into an option area and a gridded central business area. As the game progresses, each participant advances his or his player piece from location-to-location about the game board from the peripheral region through the central region and back to the peripheral region. During such travels, the participants purchase companies and tokens representing the companies which are selectively positioned on the gridded central business area. When a player's piece lands on an opponent's token, that player pays a fee for services. The game continues, with each player building and expanding on his or her companies, until all of the locations within the central business area are occupied.

5 Claims, 12 Drawing Figures

PROPERTY GAME HAVING INNER PATH SPACE MARKERS

BACKGROUND OF THE INVENTION

The invention relates to a parlor game played by a number of participants that purchase businesses and strategically expand those businesses during the course of the game.

The board game of this invention incorporates the advantages and enjoyable features associated with most parlor games. It also introduces some new and unique features which enhance the enjoyment to be experienced by those playing the game.

There are numerous parlor games of various types ranging from educational games for developing certain skills to games of chance involving very little or no skill. Some games are based upon the time-honored parlor games of chess, checkers, parchesi, and backgammon which stimulate thinking and develop the ability to plan strategies by the game's participants. These types of games have specific playing surfaces upon which the game is played and they seldom attempt to simulate real-life situations. Another general type of parlor games can be categorized as card games which include contract bridge, pinochle, hearts, poker, and the like. These games may be played with a standard deck of playing cards or may utilize cards specifically adapted for the game. These types of games typically do not require a special playing surface nor do they attempt to simulate real-life situations. However, they do stimulate thought processes which utilize mathematical concepts and strategy development. Still another general type of parlor game includes those games which have an underlying theme which attempts to simulate real-life situations and circumstances, thereby enabling the participants to experience and learn about the situations simulated. This is the general type of parlor game to which the present invention relates.

Theme-oriented parlor games typically utilize a game board, movable figures representing the players of the game, and some goal to be achieved. Because theme-oriented parlor games are very entertaining and provide a learning environment in the context of the game, they have been very popular and commercially successful. An example of a theme-oriented parlor game is the the classic game "Monopoly" (U.S. Pat. No. 2,026,082) which has a real estate theme which incorporates purchasing, trading and bargaining in a simulated real estate market. Participants in the game learn real estate terms and experience real estate occurrences such as paying rent, making improvements, mortgaging property, and bankruptcy. Themes other than the real estate market which have also been incorporated into parlor games include: community development, rights of way for a utility, the securities market, life, education and careers, zoning, the commodities market, gambling, and landlord-tenant relationships.

As mentioned above, the theme oriented parlor games typically center around a game board or playing surface. As the parlor game progresses, the participants interact with the game board and other participants in the game in a manner prescribed for that particular parlor game. Although these theme oriented parlor games have common features, each game has one or more of its own unique features which sets it apart from the other parlor games.

The parlor game of this invention utilizes a business theme which exposes the game participants to various business terms and experiences and offers several new and unique features which enhance the participant's entertainment and experience in ways heretofore not used in the parlor game art.

It is an object of the present invention to provide a game in which participants may simulate business relationships so as to learn terms utilized in the business community and experience various business related circumstances.

Another object of this invention is to provide a game playing environment in which the participants are entertained.

A further object of the present invention is to provide a game playing environment in which social interaction between the participants is stimulated and encouraged by the progress of the game.

It is another object of the present invention to provide a game board which enables the participants to simulate certain business relationships without undue complexity.

Still another object of the present invention is to provide a game playing environment which stimulates the mental faculties of the participants by calling for certain strategies, decision-making, mathematical skills, and social interaction with the other participants.

Other objects and advantages of the invention will become apparent upon reading the following detailed description and appended claims and upon reference to the accompanying drawings.

SUMMARY OF THE INVENTION

The board game of this invention has several new features and advances over the art of parlor board games. The present invention has a playing board comprising several separate and distinct board surface areas, including a plurality of company areas located about the periphery of the game playing board, a plurality of draw areas located at the corners of the playing board, a plurality of street indicating areas located along one edge of the playing board, an options area and a gridded business zone area. The board game further comprises a plurality of directional player's pieces representing each player, a plurality of company emblems and company cards corresponding to each company area, a multiplicity of tokens for each player corresponding in some identifiable manner to that player's directional player's piece, a plurality of instructional cards having information printed thereon giving directions to be followed during the course of the game, and a plurality of various denominations of simulated currency which are used as tender during the game.

After each player is given a starting sum of money, each player advances about the board by shaking dice and moving the number of spaces or locations indicated thereon. Movement about the board is generally in a clockwise direction beginning at the start and advancing around the periphery until alighting upon one of the street indicating areas. Upon landing on one of said street indicating areas, that player shakes the dice again and advances the number of spaces indicated thereon through that portion of the business zone area which corresponds to the street upon which that player had alighted. Movement through the business zone area initially is in a direction from the street indicating areas toward the options area. Once the player's directional player piece reaches the options area, the player selects which street the player's game piece will traverse and reverses its direction so as to move back toward the street indicating areas. Once the player completes movement through the business zone area he then continues around the periphery in the same fashion as previously described.

During the movement about the playing board as described above, the player may alight on any of the several company areas. Upon landing on any company area, the player has the option to purchase that company if it is then available (i.e., unowned by any player). When purchasing that company, the player pays a predetermined amount in simulated currency to the game's bank and takes a company emblem to be selectively positioned on any unoccupied space or lot in the business zone area. Also upon purchase of the company, the player may purchase additional tokens and build upon that company by locating those tokens in associative relationship with the company emblem by positioning the tokens in juxtaposition to the company emblem or any other token associated with the company emblem.

Each player advances about the board and purchases, builds, and expands companies in the same manner. In this way, the gridded business zone area becomes occupied by companies of the various players. Company expansion within the business zone area is also accomplished by a player landing on one of his own companies within the business zone area or by landing on the company area associated with one of the companies he owns. When this occurs the player has the option to purchase additional tokens which may be selectively positioned in association with that company's tokens or company emblem.

Should a player's game piece land upon a company area, a company emblem, or a token of an opposing player, that player must pay the opposing player a fee for services hypothetically rendered. The amount of the fee depends upon which company renders the services and how large the company is (determined by how many tokens are associated with that company).

When a player's game piece lands on one of the draw areas, that player draws an instructional card from a pile of such cards and follows the directions thereon.

The game advances generally as described above and continues until the entire gridded business zone area is covered by company emblems or tokens of the various players. At this time the players determine their total worth by counting the amount of currency they have on hand and adding in the value of each company they own. The player with the greatest total worth is the game winner.

BRIEF DESCRIPTION OF THE DRAWINGS

For a more complete understanding of this invention, reference should now be made to the embodiments illustrated in greater detail in the accompanying drawings and described below. In the drawings.

DETAILED DESCRIPTION OF THE PREFERRED EMBODIMENTS

Figure 6:
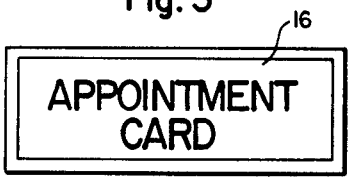
FIG. 6 is the obverse view of an instructional card entitled "Appointment Card"
Figure 7:
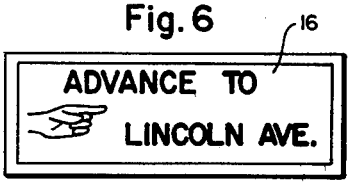
FIG. 7 is a reverse view of the instructional card of FIG. 6 showing a representative instruction printed thereon.
Figure 11:
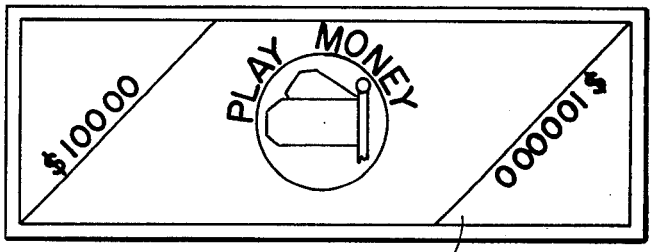
FIG. 11 is an obverse view of a representative example of simulated currency showing a denomination of $10,000.00.

Referring now to the drawings, the board game apparatus of the present invention has a game board 10, a plurality of title indicia comprising a plurality of title cards 12 (FIGS. 3 and 4) and a plurality of company emblems 14 (FIG. 5), a plurality of instructional cards 16 (FIGS. 6 and 7) having instructions printed thereon, a plurality of tokens directional game pieces 18 (FIG. 9), a plurality of movable 20, a supply of simulated currency 22 (FIG. 11) of various denominations, and a chance number selector (not shown).

Figure 1:
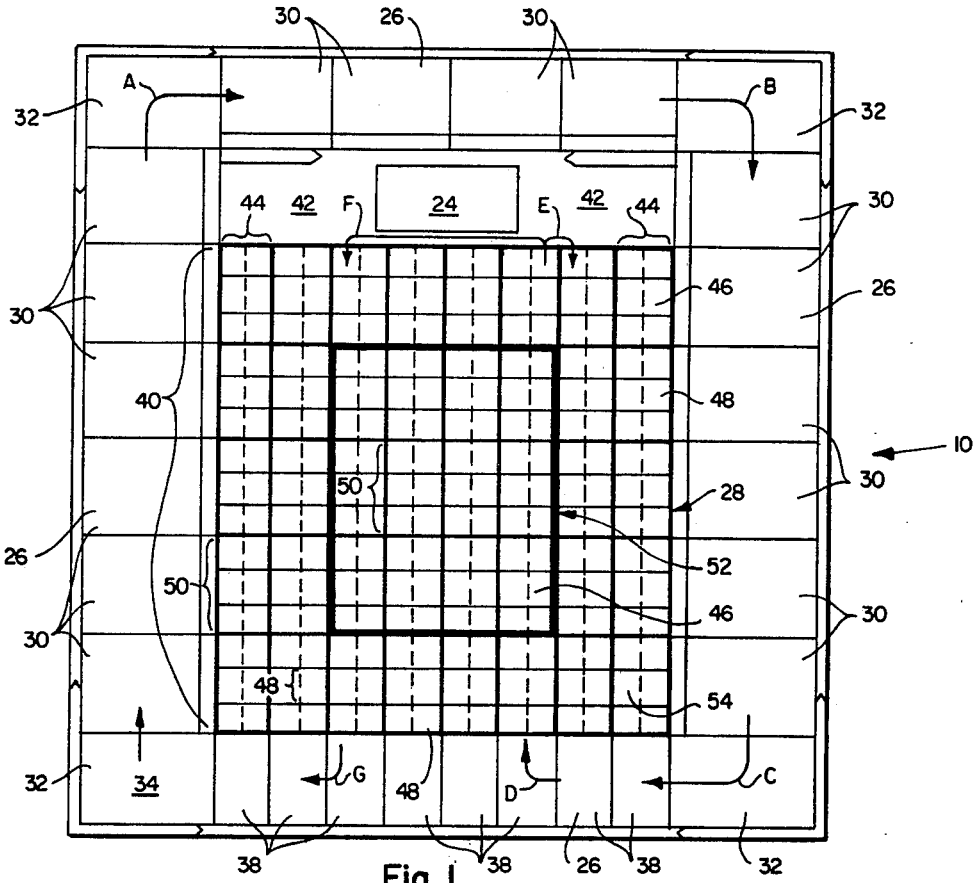
FIG. 1 is a top plan view of the playing surface of the game board without the alpha-numeric indicia and with directional arrows showing generally the direction of movement about the playing surface.
Figure 2:
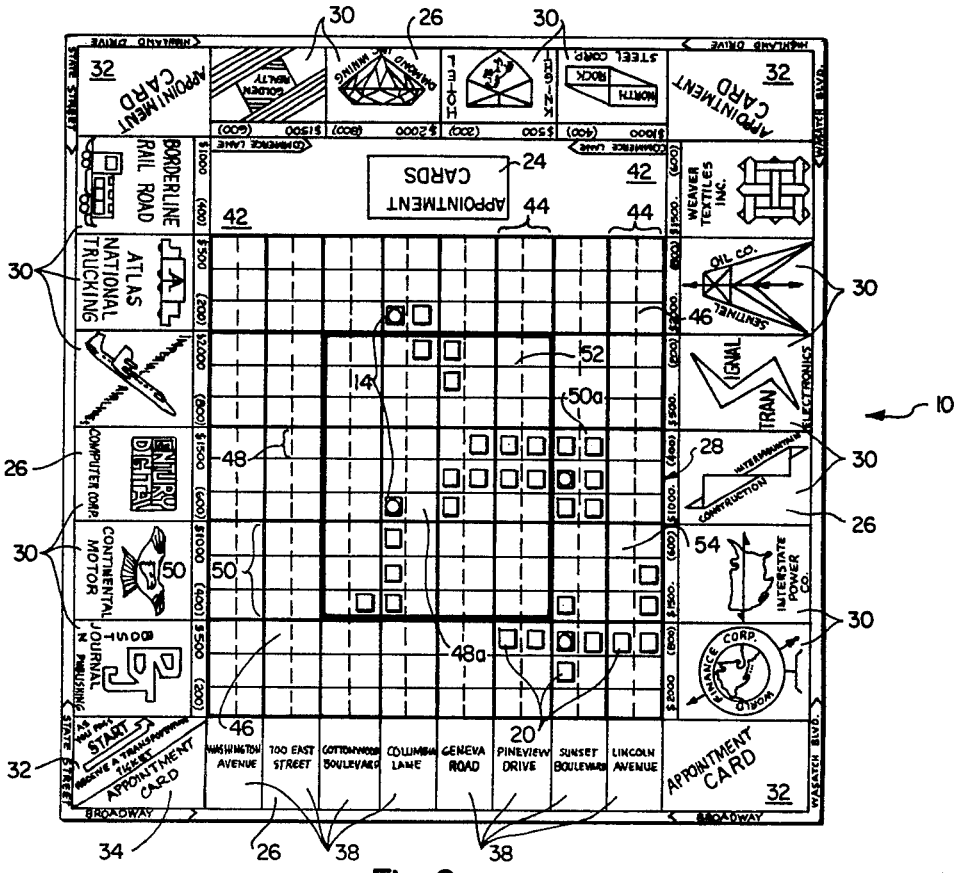
FIG. 2 is a top plan view of the game board playing surface with the preferred alpha-numeric indicia thereon and showing representative company emblems (shown schematically as a circle within a square) and tokens disposed in the gridded business zone area.
Figure 12:
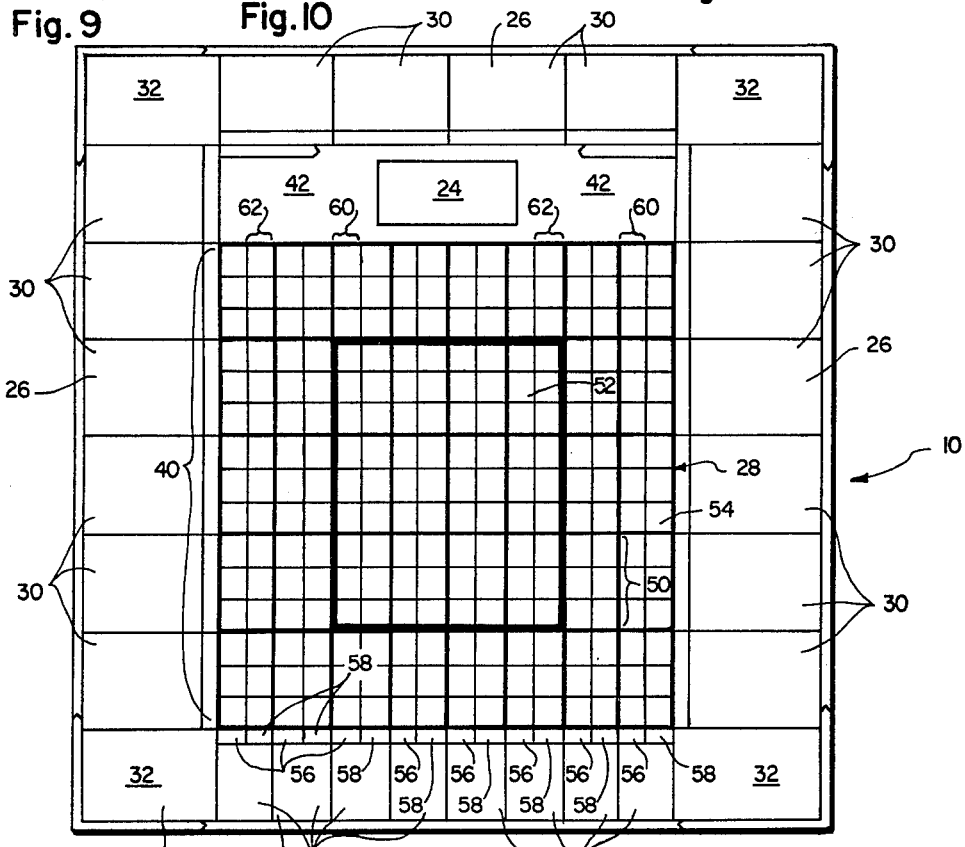
FIG. 12 is a top plan view of an alternative embodiment of the game board playing surface showing odd and even travel paths.

As shown principally in FIGS. 1, 2 and 12, the game board 10 has a substantially rectangular flat playing surface and comprises a peripheral region 26 and a central region 28. The peripheral region 26 is subdivided into a number of separate locations positioned about the periphery of the game board 10. These locations are grouped according to type into three separate groups. In the preferred embodiment, the first group of locations are company locations 30 which are disposed intermediate of the four corner locations 32 along the periphery of three of the four sides of the game board 10. Each of the company locations 30 represents a company that may be purchased during the course of the game, as will be explained in detail below. As shown in FIG. 2, it is preferred that each company location 30 represent a different type of business such as the specific fanciful businesses illustrated, namely: The Boston Journal, a publishing company; Continental Motor, a motor company; Century Digital Computer Corp., a computer company, Imperial Airlines, an airline company; Atlas National Trucking, a trucking company; Borderline Railroad, a railroad; Golden Realty, a real estate firm; Diamond Mining, Inc., a mining company; Knight Hotel, a hotel chain; North Rock Steel Co., a steel company; Weaver Textiles, a textile company; Sentinel Oil Co., an oil company; Transignal Electronics, an electronics company; Intermountain Construction, a construction company; Interstate Power Co., a power company; World Finance Corp., a major bank or financial institute. It is also preferred that the company locations 30 be arranged in graduated alignment according to the relative economic presence of such types of companies in the real business community. For example, an oil company typically has a larger economic presence than a publishing company. By doing so, this injects some realism into the game of this invention which is intended to simulate the world business climate. However, it is to be understood that the specific fanciful names of the companies, the types of companies, or the arrangement of companies is not critical to the game, rather any company and company name may be used. Indeed, the entire theme of the game of this invention may be changed without avoiding the true spirit of this invention by utilizing something other than companies in the company locations 30.

The second group of locations comprise the corner locations 32 which serve as special locations during the course of the game. In the preferred embodiment, the corner locations 32 serve as a cue to the game participants to draw an instructional card 16 (FIGS. 6 and 7) called an "Appointment Card" from a pile of such cards set aside specifically for that purpose. It is preferred that a specific area on the game board 10, a draw pile area 24, be provided for the instructional cards 16. Each instructional card 16 has directions printed thereon for the participant who draws the card to follow.

In addition, one of the corner locations 32 is designated as the start location 34 which serves two principal functions other than to cue the drawing of an instructional card 16. The start location 34 serves as the position from which the game is begun by placing each participant's game piece 18 there and it also serves to cue a participant to select an optional movement card 36 (FIG. 8) called a "Transportation Ticket" each time a participant's game piece 18 lands on or passes over the start location 34.

The third group of locations comprises street locations 38 located intermediate of a pair of corner locations 32 along the remaining side of the game board 10. These street locations 38 function principally to direct movement of the participant's game pieces 18 through the central region 28 of the game board 10. Such movement through the central region 28 of the game board 10 will be explained in detail below. As shown in FIG. 2, it is preferred that the street locations 38 bear the following names: Lincoln Avenue, Sunset Boulevard, Pineview Drive, Geneva Road, Colombia Lane, Cottonwood Boulevard, 700 East Street, and Washington Avenue. However, it should be understood that any street name which differentiates one street from another street may be used.

The central region 28 of the game board 10 comprises a central area 40 and a option location 42. In the preferred embodiment as shown in FIGS. 1 and 2, the central area 40 comprises a plurality of locations aligned in rank and file so as to form a grid. The locations in the central area 40 are also grouped into linear separate path segments 44 which correspond to the street locations 38. As preferred, there is one path segment 44 for each street location 38. Nevertheless, it should be understood that in other embodiments there may be more than one path segment 44 for each street location 38 (see for example, FIG. 12 and the description relating thereto) or the path segments 44 may be nonlinear and need not form a grid. The path segments 44 are subdivided by a dashed line 46 which divides each location into two separate lots 48.

Also, it is preferred that each path segment 44 be divided into separate and distinct territories 50, each territory comprising a group of three adjacent locations or six adjacent lots 48. It is preferred that each path segment 44 comprise five (5) of said territories 50, however, such territories 50 need not be restricted to one path segment 44 nor need they be restricted to the numbers of locations or lots 48 as preferred herein.

The central area 40, as described above, is subdivided into two control districts, a central control district 52 which comprises the twelve central-most territories 50 and an outer control district 54 which comprises the surrounding twenty-eight territories 50.

Movement about the game board 10 by the participants' game pieces 18 is generally in the direction of the arrows shown in FIG. 1. Each participant's game piece 18 begins the game at the start location 34 and proceeds generally in a clockwise direction about the peripheral region 26 of the game board 10 (from arrow A to arrow B to arrow C) until arriving at one of the street locations 38. Upon arriving at a street location 38, that participant's game piece 18 proceeds along the path segment 44 corresponding to the subject street location 38 as representively shown at arrow D. Travel continues along the subject path segment 44 until the participant's game piece 18 arrives at the option location 42, called "Commerce Lane" in the preferred embodiment. At this point, the participant has the option to select any of the path segments 44 (for example, arrow E or arrow F) for his or her return path back to the peripheral region 26. Upon arriving again at a street location 38, the participant's game piece 18 generally clockwise movement about the peripheral region 26 (arrow G). Movement of each participant's game piece 18 continues in the manner described in increments according to the roll of dice or some other chance number selector (not shown) about the peripheral region 26 through the central region 28 and back to the peripheral region 26 until the completion of the game.

Figure 9:
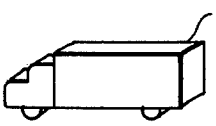
FIG. 9 is a perspective view of a directional player's game piece conforming roughly to the shape of a truck.
Figure 10:
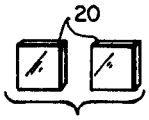
FIG. 10 is a perspective view of two tokens for selective positional disposition in association with a company emblem on the playing surface of the game board.

The other implements used in the game serve principally as accessories to the game board 10 and function to facilitate play of the game. The game piece 18, illustrated at FIG. 9, is a figure having a directional indicator which designates the direction of movement for the game piece 18. This feature is important because there are two possible opposing directions of travel each participant's game piece 18 travels in each passage through the central region 28. The game piece 18 also has differentiating indicia so that one participant's game piece 18 may be distinguished for another participant's game piece 18. It is preferred that such differenting indicia be color, but any other appropriate indicia will suffice.

Figure 3:
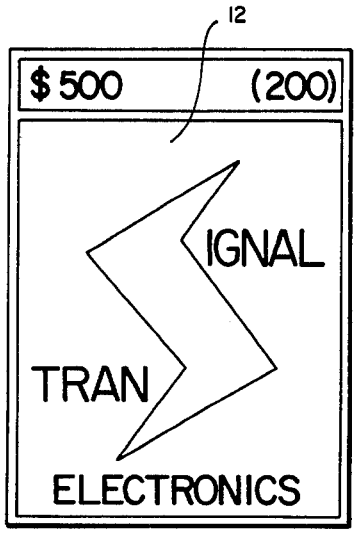
FIG. 3 is an obverse view of a title card showing the compnay name and business and the purchase price.
Figure 4:
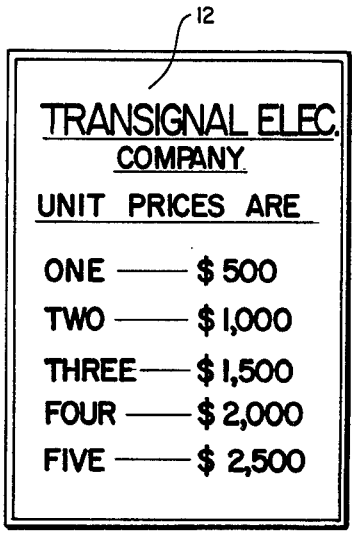
FIG. 4 is a reverse view of the title card of FIG. 3 showing information relating to the purchase of tokens associated with said company.

The title card 12 (a representative card is shown at FIGS. 3 and 4) is used in a manner similar to a deed or title of ownership. The participant who possesses the title card 12 for a particular company owns that company and can deal with that company consistent with his incidence of ownership. The company emblem 14 has indicia thereon which corresponds to whichever company the emblem 14 represents and is used to define the location of a company in the central area 40. When a participant acquires a title card 12 this entitles that participant to selectively position the corresponding company emblem 14 upon any unoccupied lot 48 within the central area 40 (see FIG. 2).

Numerous tokens 20 are provided for each participant which bear differentiating indicia which corresponds to each respective participant's game piece 18. For example, the tokens 20 for each participant may be constructed of a material having the same colors as each participant's game piece 18. It is also preferred that the tokens 20 be made of a transparent material. This enables the tokens 20 to also be utilized as an overlay which can be placed on top of a participant's company emblems 14 to further indicate which companies are owned by which participant without impeding the identifying indicia on the emblems 14.

During the course of the game, a participant may have the occasion to purchase one or more tokens 20 for disposition in the central area 40. As will be explained more fully below, since each purchase of a token 20 relates to a particular company owned by the purchasing participant, each token 20 purchase entitles that participant to selectively position the token 20 in association with the corresponding company emblem 14 upon any unoccupied lot 48 in juxtaposition to said company emblem 14 or any token 20 previously positioned in association with said company emblem 14.

The simulated currency 22 provides a monetary standard or medium by which the participants transact business and ultimately determine which participant has the greatest simulated worth.

The optional movement cards 36 and the instructional cards 16 are used to affect movement of the participant's game pieces 18 independent of movement governed by the chance number selector.

Movement about the game board 10 for each participants'game piece 18 is generally in increments determined by the chance number selector (not shown). The chance number selector may comprise any of a number of chance number determiners such as a spinner, dice, or a deck of cards bearing numerical indicia. For example, a participant's game piece 18 is moved "six" locations if the number "six" is determined by the chance number selector.

As the participants' game pieces 18 advance about the game board 10, the participants interact with the game board 10 according to where each participant's game piece 18 rests at the end of the each participant's turn of movement, that a participant's game piece 18 rests on a company location 30 at the end of that participant's turn of movement, that participant has the option to purchase the corresponding company, if it is unowned, for a predetermined amount of simulated currency 22. If the company is owned by an opposing player, the participant pays the opposing player a predetermined sum of simulated currency 22 depending upon the size of the opposing player's company. If the participant's game piece 18 rests upon a corner location 32 at the end of that participant's turn, that participant selects an instructional card 16 from a pile of randomly arranged instructional cards 16 and follows the instructions printed thereon. If the participant's game piece 18 rests upon one of the street locations 38 at the end of his turn, the path segment 44 for the immediate future travel of the participant's game piece 18 is determined. If a participant's game piece 18 rests upon a location occupied by one or more of the opposing players' tokens 20, the participant must pay the opposing player(s) an amount of simulated currency 22 determined by the company to which the token 20 is associated and the number of tokens 20 associated with that company.

Upon the purchase of a company, the purchasing participant receives and possesses that company's title indicia representing his or her ownership. The title indicia comprises a title card 12 and a company emblem 14. A representative title card 12, at FIGS. 3 and 4, shows that certain information is printed thereon. On the obverse of the title card (FIG. 3) appears the company name, the purchase price, and a designation of the fee for services to be charged to opposing players. In the preferred embodiment, the fee for services represents 40% of the purchase price. However, any other predetermined fee arrangement may be utilized. On the reverse of the company card 12 (FIG. 4), appears the company name and a breakdown of token 20 purchase prices. For example, in the preferred embodiment, as many as five (5) tokens 20 may be purchased at particular times when the participant may purchase such tokens 20. Thus, with respect to the company represented in FIG. 4, it would cost a participant $2,000 in simulated currency 22 to purchase four (4) tokens 20 to be associated with that company.

Figure 5:
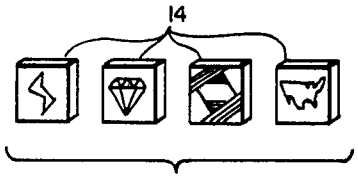
FIG. 5 is a perspective view of several company emblems for selective positioning upon the game board playing surface.

The company emblem 14 (representative samples are shown at FIG. 5) is a representative of the corresponding company and is selectively positioned upon one of the lots 48 located in the central area 40 of the game board 10. The selective positioning of the company emblem 14 is upon any unoccupied lot 48 according to whatever strategy the participant choses to employ in locating his companies within the central area 40. FIG. 2 illustrates an exemplary arrangement of company emblems 14 and tokens 20 associated therewith.

In conjunction with owning a company, a game participant may build up or expand his company by purchasing tokens 20 which are associated with a company that the participant owns. In the preferred embodiment, a purchase of tokens 20 is permitted upon the occurrence of any of three events. First, when a participant purchases a company, as described above, he or she has the option to simultaneously purchase additional tokens 20. It is preferred that each additional token 20 have a purchase price equal to the purchase price of the company and that the participant be restricted in the number of tokens 20 that can be purchased at one time. Nevertheless, any predetermined purchase price for tokens 20 may be used. Second, a participant may purchase tokens 20 when the participant's game piece 18 rests upon a company location 30 corresponding to a company which that participant already owns. Again, it is preferred that the number of tokens 20 which may be purchased upon such an occurrence be restricted. Third, a participant may purchase additional tokens 20 when the participant's game piece 18 rests upon a lot 48 occupied by one of said participant's tokens 20. It should be noted that in each instance when the purchase of tokens 20 is permitted, such purchase relates to a particular company. Thus, it is preferred that the tokens 20 purchased assume an identity which corresponds to said company by requiring that the tokens 20 be selectively positioned on the central area 40 of the game board 10 so as to be in association with the company emblem 14 which represents the company related to the purchase.

To assure that tokens 20 are selectively positioned in associative relationship with the appropriate company emblem 14 and to prevent confusing comingling of tokens 20 associated with different companies, it is preferred that the positioning of tokens 20 be governed as follows. First, any newly purchased token 20 may be positioned only on an unoccupied lot 48. Second, any newly purchased token 20 is to be selectively positioned in association with the appropriate corresponding company emblem 14 by positioning said token 20 in juxtaposition to the company emblem 14 or to a previously positioned token 20 which is in associative relationship to the company emblem 14. This assures that each company as it expands can be readily identified and prevents the confusion that would be created by a stray token 20. Third, tokens 20 or company emblems 14 representing different companies owned by the same game participant are not to be positioned adjacent each other because this would create confusion as to which tokens 20 were associated with which of the respective company emblems 14. These governing rules are generally illustrated in FIG. 2. It should be noted that FIG. 2 illustrates the relative positioning of four separate companies showing the tokens 20 in associative relationship to each company emblem 14. Further, if it is assumed that the four companies shown are owned by the same game participant, FIG. 2 also demonstrates that none of the tokens 20 of any one company are positioned adjacent any token 20 of any other company.

In the preferred embodiment, there are additional means by which a company may be expanded. One way of expanding a company is to merge one company into another. Another way of expanding a participant's company is to bridge over an opposing player's company to an area of unoccupied lots.

Merger of one company into another may be accomplished in any of a number of ways, however, it is preferred that merger be restricted to the following governing rules. Merger can only be accomplished when two, three, or four companies owned by the same game participant are in a merging positional relationship, i.e., by placing a single token 20 upon an unoccupied lot 48 said token 20 would be positioned so as to be in associative relationship (as defined herein) with the two, three, or four companies. For example, if a token 20 is positioned at lot 48*a* it would be juxtapositioned to two companies. Once two or more companies are in merging positional relationship, to effect a merger the game piece 18 of the participant owning the companies must rest upon a lot occupied by one of the companies. Then, at that participant's option, he or she may purchase additional tokens 20, as described above, and place one of said tokens 20 on the merger lot (for example, lot 48*a* as illustrated in FIG. 2). By doing so, the participant has merged the companies together. The surviving company is the company which effected the merger, while the other company(ies) merge therein. Consequently, once a merger has occurred, the company emblems 14 of the company or companies merged into the surviving company are removed from the central area 40 and the participant who effected the merger surrenders to the game's bank his or her title indicia in the merged company or companies. Upon such surrender, the title indicia again becomes available for purchase by any game participant. In this manner, there are usually one or more companies available for purchase at any given time during the entire course of the game.

Since there is no restriction which prevents the game participants from positioning their tokens 20 adjacent the tokens 20 of an opposing participant, frequently the expansion of a company is blocked or restricted because there are few or no unoccupied lots 48 juxtaposed to the company. Thus, in the preferred embodiment, the movement of "bridging" is permitted (not shown). In bridging a participant's company over an opposing player's company to gain access to unoccupied lots 48, the bridging participant purchases a right-of-way over an opposing participant's company to unoccupied lots 48 on the game board 10. The purchase price to be paid the opposing player can be a predetermined amount for each bridged lot 48 or it can be a matter of bargaining and negotiation between the two affected participants.

As noted, the events of bridging and merger are preferred features of the game of this invention. However, it is to be understood that merger and bridging are features which may be modified or eliminated without departure from the spirit of this invention.

Figure 8:
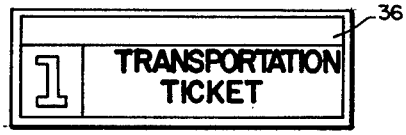
FIG. 8 is an obverse view of an optional movement card entitled "Transportation Ticket" having a numerical indicator printed thereon.

In order to inject additional strategic considerations into the preferred embodiment, the parlor game of this invention also comprises certain other features. During the course of the game, as each participant's game piece lands on or passes over the start location 34 that participant receives an optional movement card 36 (as shown in FIG. 8). In the preferred embodiment, the optional movement card 36 is called a "transportation ticket" and has a numerical indicia thereon. The number indicated represents the number of locations which the participant, possessing the ticket, may move his or her game piece 18 on his or her turn optionally in lieu of determining the number via the chance number selector. Strategy is involved in that the participant decides when to use the optional movement card 36, he or she decides whether to preserve it for a more opportune time or to utilize it to meet a more immediate goal or need.

An additional strategic consideration relates to the use of territories 50 and control districts. In the preferred embodiment, each participant who builds upon his or her companies so as to occupy all of the lots 48 in a territory 50 (see for example, territory 50*a* in FIG. 2) receives a bonus payment of simulated currency 22 from the game's bank. In effect, the participant receives the bonus for controlling an entire territory 50. The amount of the bonus payment depends upon whether the territory 50 is within the central control district 52 or the outer control district 54. A greater bonus is paid if the territory 50 is within the central control district 52 than is paid if the controlled territory 50 is within the outer control district 54. Strategy is involved in the attempt to control territories 50 because the goal of the game of this invention is to have the greatest total worth at the end of the game. Thus, each bonus payment received for controlling a territory 50 increases a participant's total worth.

It should be understood that the territories 50 and control districts 52 and 54 need not necessarily take the form shown and described herein. Territories 50 and control districts 52 and 54 can be of any size and shape. However, in the preferred embodiment the territories 50 and control districts 52 and 54 take the form shown and described herein. In this manner, since it is preferred that a participant can purchase no more than five (5) tokens 20 at any one time, a participant is unable to position the purchased tokens 20 so as to control an entire territory 50 on any one turn.

In an alternative embodiment, as shown in FIG. 12, the configuration of the game board is slightly altered. Each of the street locations 38 further comprises an even indicator 56 and an odd indicator 58. Further, the central area 40 of the game board 10 comprises even path segments 60 and odd path segments 62 arranged in rank and file so that each location within the path segments 60 and 62 aligns to form a grid.

With the even-odd alternative embodiment, a game participant's game piece 18 traverses the central area 40 on either an even path segment 60 or an odd path segment 62. When a participant's game piece comes to rest upon a street location 38 at the end of the participant's turn the number of locations travelled to arrive there determines whether an even path segment 60 or an odd path segment 62 is to be traversed. For example, if the game piece 18 had moved three (3) locations to arrive at the street location 38, the game piece 18 would be moved along the odd path segment 62 corresponding to the street location 38 on the participant's next turn of movement.

Generally the procedure for playing the game of this invention is as follows. After the game board 10 has been set up for access to each participant and each participant is given a predetermined starting amount of simulated currency, the instructional cards 16 are placed in a pile, in random order, on the draw pile area 24 and each participant places his or her game piece 18 at the start location. Sequentially in turn, each participant moves his or her game piece 18 about the game board 10 according to the number indicated by a chance number selector such as dice.

If a participant's game piece 18 comes to rest on a company location 30 for an unowned company, that participant has the option to purchase the company and tokens 20 to be associated therewith. If the participant purchases the company, he or she selectively positions the corresponding company emblem 14 and any tokens 20 purchased on the central area 40 of the game board 10 according to the rules on associative positional placement and whatever strategy the participant chooses to use.

If a participant's game piece 18 comes to rest on a company location 30 for a company owned by an opposing player, that participant pays such opposing player a sum of simulated currency 22 determined by the size of the opposing player's company. It is preferred that no such payment is required if the subject company occupies more than ten (10) lots 48 in the central area 40.

If a participant's game piece 18 comes to rest on a corner location 32, the participant draws an instructional card 16 from the draw pile area 24 and follows the directions printed thereon.

If a participant's game piece 18 comes to rest on a street location 38, the participant, on his or her next turn of movement (this can be on the same sequential turn or the next sequential turn of the participant), moves the participant's game piece 18 along the path segment 44 corresponding to the subject street location 38. Upon arriving at the option location 42, the participant selects which path segment 44 to traverse in returning to the peripheral region 26 of the game board 10 and completes the remainder of his or her turn of movement.

If a participant's game piece 18 comes to rest on a location within the central area 40 which is occupied by one or more tokens 20 or company emblems 14 of an opposing player, that participant pays each such opposing player a sum of simulated currency 22, representing a payment for services rendered, determined by the company and the size of the company involved. It is preferred that the sum be 40% of the total purchase price of the company and all tokens 20 associated therewith.

If a participant's game piece 18 comes to rest on a location within the central area 40 which is occupied by one or more tokens 20 he or she owns, the participant may purchase additional tokens 20 for selective positional disposition on the central area 40. In positioning newly purchased tokens 20 the participant may effect a merger if the company involved in the purchase is in merger position with one or more of the participant's other companies.

If a participant's game piece 18 comes to rest on a company location 30 for a company owned by the participant, that participant may purchase additional tokens 20 for selective positional dispostion in associative relationship to the subject company on the central area 40.

If a participant's game piece 18 rests on or passes over the start location 34, the participant receives an optional movement card 36 which can be used at the participant's option in lieu of the chance number selector to effect movement of the participant's game piece 18.

The game proceeds as set forth above until all lots 48 in the central area 40 are occupied. At that time the participants determine their total worth and the player with the greatest total worth is the winner.

While particular embodiments of the invention have been shown and described, it is to be understood that the invention is not limited thereto since modifications, within the scope and spirit of this invention, may be made by those skilled in the art, particularly in light of the foregoing teachings.

What is claimed and desired to be secured by United States Letters Patent is:

1. A board game apparatus for a plurality of participants comprising:

a game board defining a playing surface which comprises:

a peripheral region having a plurality of distinct locations grouped into a first group of locations having first indicia associated therewith, a second group of locations having second indicia associated therewith, and a third group of locations having third indicia associated therewith; said peripheral region defines a first portion of a plurality of continuous paths; and a central region having an option area and a central area; said central area comprising a plurality of locations defining a plurality of path segments wherein each path segment is disposed intermediate of said option area and one of the locations of said third group of locations and each location of each path segment is subdivided into a plurality of lots; said central region defines a second portion of a plurality of continuous paths;

a plurality of title indicia comprising a plurality of title cards and a plurality of emblems; one title card and one emblem being associated with each location of said first group of locations and having identifying indicia corresponding to the first indicia of such location;

a plurality of instructional cards being associated with the locations of said second group of locations and having instructions thereon;

a plurality of movable game pieces, one for each participant, for movement from location to location, each game piece having directional indicia for distinguishing its direction of movement and differentiating indicia for distinguishing between said game pieces;

a plurality of tokens for associative selective positioning with said emblems on said central area of said game board; a plurality of said tokens being associated with each game piece and having differentiating indicia corresponding to the differentiating indicia of such game piece for distinguishing between said tokens and game pieces;

a supply of simulated currency providing a monetary standard; and selector means for randomly determining the number of locations to be traversed by a participant's game piece on a participant's turn; said game pieces to be advanced in a continuous path from location-to-location about the peripheral region and through the central region returning to the peripheral region.

2. A board game apparatus as set forth in claim 1 wherein each location of each path segment is subdivided into a pair of lots.

3. A board game apparatus as set forth in claims 1 or 2 wherein said central area comprises said lots aligned in rank and file defining a grid.

4. A board game apparatus as set forth in claim 3 wherein said grid is subdivided into a plurality of territories each comprising a plurality of lots.

5. A board game apparatus as set forth in claim 4 further comprising a central district having a plurality of said territories.

* * * * *